US009637956B2

(12) United States Patent
Niegeloh et al.

(10) Patent No.: US 9,637,956 B2
(45) Date of Patent: May 2, 2017

(54) DOOR HANDLE ASSEMBLY FOR A MOTOR VEHICLE

(71) Applicants: Andreas Niegeloh, Solingen (DE); Markus Bartels, Mulheim (DE)

(72) Inventors: Andreas Niegeloh, Solingen (DE); Markus Bartels, Mulheim (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 408 days.

(21) Appl. No.: 14/307,065

(22) Filed: Jun. 17, 2014

(65) Prior Publication Data

US 2014/0375069 A1 Dec. 25, 2014

(30) Foreign Application Priority Data

Jun. 25, 2013 (DE) ..... 10 2013 106 610

(51) Int. Cl.
*E05B 3/00* (2006.01)
*E05B 85/16* (2014.01)
(Continued)

(52) U.S. Cl.
CPC ..... *E05B 85/16* (2013.01); *E05B 77/06* (2013.01); *E05B 85/10* (2013.01); *E05B 77/02* (2013.01); *Y10S 292/22* (2013.01); *Y10T 292/57* (2015.04)

(58) Field of Classification Search
CPC ..... Y10S 292/22; E05B 77/02; E05B 77/04; E05B 77/06; E05B 85/10; E05B 85/16
(Continued)

(56) References Cited

U.S. PATENT DOCUMENTS 6,648,382 B1 11/2003 Mönig et al.
7,481,468 B2 * 1/2009 Merideth ..... E05B 77/06 292/137
(Continued)

FOREIGN PATENT DOCUMENTS

DE 19929022 1/2001
DE 102008000098 7/2009
(Continued)

OTHER PUBLICATIONS

European Search Report of Related European Application No. EP 14 17 0327 dated May 27, 2016.

*Primary Examiner* — Carlos Lugo
(74) *Attorney, Agent, or Firm* — Fay Sharpe LLP

(57) ABSTRACT

A door handle assembly for a motor vehicle includes an operating handle, a coupling device, and a locking device which is moveably retained on a handle mounting. An acceleration force can move the assembly from a resting position in which an actuation of the operating handle is possible, in a first blocking direction in which an actuation of the assembly by the operating handle and/or the coupling device is blocked. The locking device can move from the resting position in a second blocking direction when acted on by an acceleration force, in which an actuation of the assembly via the operating handle and/or the coupling device is blocked, wherein the second blocking direction is in the opposite direction from the first blocking direction. Movement of the assembly is blocked by the operating handle, or the coupling device, even with alternating acceleration forces resulting from a crash.

8 Claims, 3 Drawing Sheets

(51) Int. Cl.

| | |
|---|---|
| ***E05B 77/06*** | (2014.01) |
| ***E05B 85/10*** | (2014.01) |
| *E05B 1/00* | (2006.01) |
| *E05B 77/02* | (2014.01) |

(58) Field of Classification Search
USPC ..... 292/336.3
See application file for complete search history.

(56) References Cited

U.S. PATENT DOCUMENTS

| | | | | |
|---|---|---|---|---|
| 8,152,209 | B2 * | 4/2012 | Lee | E05B 77/06 292/336.3 |
| 8,366,159 | B2 * | 2/2013 | Patel | E05B 77/06 292/203 |
| 8,840,156 | B2 * | 9/2014 | Savant | A47B 47/0008 292/336.3 |
| 8,857,866 | B2 * | 10/2014 | Savant | E05B 77/06 292/336.3 |
| 9,404,292 | B2 * | 8/2016 | Da Deppo | E05B 77/06 |
| 9,435,146 | B2 * | 9/2016 | Muller | E05B 77/06 |
| 2008/0136199 | A1 * | 6/2008 | Kim | E05B 77/06 292/340 |

FOREIGN PATENT DOCUMENTS

| | | | | |
|---|---|---|---|---|
| DE | 102009053553 | | 5/2011 | |
| DE | 20 2011 106661 | U1 | 1/2013 | |
| DE | 10 2011 085510 | A1 | 5/2013 | |
| FR | EP 1605122 | A1 * | 12/2005 | E05B 77/06 |
| IT | EP 2942461 | A1 * | 11/2015 | E05B 77/06 |
| WO | WO 2014203930 | A1 * | 12/2014 | E05B 77/06 |

* cited by examiner

DOOR HANDLE ASSEMBLY FOR A MOTOR VEHICLE

BACKGROUND

The invention addresses a door handle assembly for a motor vehicle having a frame-like handle mounting, a manually actuatable operating handle, which is moveably supported on the handle mounting for the opening of a door or hatch of the motor vehicle by a user, a coupling device pivotally supported on the handle mounting, by means of which a movement of the operating handle can be transferred to a vehicle-side closing assembly, and a locking device serving as a mass locking device, which is moveably retained on the handle mounting and is designed such that, with the effect of an acceleration force, it can be moved, due to the inertia of its mass, from a resting position, in which an actuation of the operating handle is possible, in a first blocking direction, in which an actuation of the closing assembly by means of the operating handle and/or the coupling device is blocked.

Door handle assemblies of this type, having a locking device serving as a mass locking device, are intended to prevent the acceleration forces occurring during an accident from leading to an actuation of the operating handle, or the door handle, respectively, and resulting in an unintended opening of the door of the motor vehicle, which is accompanied by significant risks for a passenger in the vehicle. With typical door handle assemblies for motor vehicles, the handle components that are to be actuated by a user are mechanically coupled to a vehicle-side closing assembly (the actual door locking device). The movement of the door handle, or the operating handle, respectively, is transferred to the closing assembly by means of the coupling device, and the door can open. In the case of an accident, the acceleration forces act, in unfavorable conditions, in the manner of an actuation of the handle components by a user, because the handle can be accelerated in the opening direction due to inertia. With an operating handle, or a door handle, respectively, without a corresponding locking device, the movement of the handle components in relation to the vehicle leads to a transference to the closing assembly in the vehicle via the mechanical coupling device, and to a releasing of the door. An example scenario for such a situation is normally a lateral impact with an obstacle or another vehicle. A locking device of this type, serving as a mass locking device, which is also referred to as a crash lock, is known for door handle assemblies from the prior art.

By way of example, DE 199 29 022 C2 describes a corresponding mass locking device in the form of a pivotal locking member, which is intended to prevent an actuation of the handle in the event of crash. In the case of an accident, forces are exerted on a locking member, and an unintended movement of the handle, likewise caused by the forces acting thereon, is blocked. A door handle assembly is also known, for example, from DE 10 2009 053 553 A1. With this door handle assembly, an additional force acts on the operating handle, or the door handle, respectively, by means of a crash lock, by means of which an unintended movement of the operating handle is to be prevented.

A door handle assembly of the type indicated in the introduction, having a locking device designed in the form of a crash lock is known, for example, from DE 10 2008 000 098 A1.

Known crash locks of this type can be designed as a pendulum mass, such that the crash lock is displaced into the movement path of the operating handle as the result of the force acting on it, thus blocking the operating handle. In addition, there are also known crash locks that lock in a blocking position, and after their activation and locking in position, can only be deactivated again by means of a targeted intervention in the door handle unit, such that the door handle can again be used in the normal operation thereof.

With door handle assemblies known from the prior art, having a mass locking device, or a locking device, respectively, which do not lock in position when activated, but instead return, or swing back, respectively, to their normal operating position, or resting position, there is the disadvantage that, with the effects of acceleration forces, the locking device can oscillate, or swing back and forth, respectively. As is known from accident research results, alternating acceleration forces may occur during a lateral collision, which lead to a type of fluttering of the door handle assembly, thus to a back and forth oscillation. This fluttering or oscillation is responsible for the locking device being able to become disposed in a position during the swinging procedure, in which the operating handle, or the coupling device, respectively, is not blocked, despite the crash. This is because the known locking devices are only active in a relatively small locking path range, or displacement path range, which blocks an actuation of the coupling device designed as a displacement lever, or the operating handle, respectively, such that, with either strong and pronounced oscillations, or with oscillations lasting over a long period of time as the result of the effects of acceleration forces, there is the danger that with a locking device oscillating, or swinging, respectively, back and forth, the displacement path range is not long enough to securely prevent a blocking [sic: actuation? (translator's note)] of the operating handle, or the displacement lever. As a result, in the event of a crash the locking device can assume a position during the oscillation process, despite its activation, in which it does not block the operating handle, or the displacement lever. It is furthermore disadvantageous that the known door handle assemblies, having a crash lock, are configured solely for an acceleration force directed toward the interior of the vehicle. An acceleration force in the opposite direction is not taken into account, although it too can have an effect resulting in an undesired actuation of the operating handle.

BRIEF SUMMARY

For this reason, the invention assumes the objective of creating a solution, which provides a door handle assembly in a structurally simple manner, and cost effectively, with which the locking device reliably and securely blocks the operating handle, or the coupling device, even with alternating acceleration forces resulting from a crash.

With a door handle assembly of the type indicated in the introduction, the objective is attained according to the invention in that the locking device is designed such that it can move from the resting position in a second blocking direction when subjected to the effects of an acceleration force, due to the inertia of its mass, in which an actuation of the closing assembly by means of the operating handle and/or the coupling device is blocked, wherein the second blocking direction is in the opposite direction of the first blocking direction.

Advantageous and beneficial designs and further developments of the invention can be derived from the dependent claims.

By means of the invention, a door handle assembly for a motor vehicle is provided, which is distinguished by a functional construction and a simple and cost-effective assembly. Because the locking device is designed such that it can move from a resting position, not only in a first blocking direction, but also in second blocking direction, when acted on by an acceleration force, the field of application for the locking device is increased, because this can now no longer be activated by only one acceleration force acting in a single, predetermined direction, but can also be activated by the effects of an acceleration force in a second direction. This characteristic of the locking device according to the invention is advantageous in a vehicle accident, or crash, in which, due to the acceleration forces acting thereon, pronounced oscillations prevail, which lead to a back and forth oscillation, or swinging, or fluttering, respectively, of the locking device between the resting position and a blocking position. Due to the possibility, according to the invention, that the locking device can move in a second blocking direction during a crash, the operating handle and/or the coupling device is also effectively blocked in the event of a return oscillation, or swinging, respectively, of the locking device during a crash, because the locking device moves during a return swing from a first blocking position, through the resting position, in a second blocking direction, by means of which the locking device never remains in the resting position at any point in time, but instead, only passes through the resting position over the course of a minimal time period.

It is beneficial, with respect to a minimal installation space that is to be expected, if, in the design of the invention, the locking device is rotatably supported on the handle mounting by means of a rotational axis, and if the movement of the locking device in the first and second blocking directions is a rotational movement of the locking device. The rotational axis can rotatably support the locking device at its midpoint thereby, which likewise has a beneficial effect on the installation space that is to be expected.

In order to implement a blocking of the operating handle when it is acted on by corresponding accelerating forces, which act in the direction of the interior of the vehicle, or in the opposite direction, in a further design the invention provides that the locking device can rotate from the resting position over a maximum possible rotational angle about the rotational axis when subject to the effects of an acceleration force, wherein the rotational angle can, for example, be ±90°, preferably ±270°. This movement path for the locking device when it is activated is long enough that the crash state, which is characterized by the effects of alternating acceleration forces, and the oscillations, or fluttering movements, respectively, of the vehicle structure, have come to a stop, even before the locking device has already been returned, by means of its spring tension, to its resting position.

An increased life expectancy of the motor vehicle can be observed, wherein the life expectancy frequently exceeds an age of more than 10 years. The locking device is not actuated over a long period of time thereby, because this only occurs in the exceptional event of a vehicle accident. The locking device is a component of a door handle assembly and can, for example, be provided on an exterior door handle, which is subjected to the effects of weather and corrosion. With the known door handle assemblies designed in the manner of an exterior door handle, it cannot be guaranteed that, even after years, the desired and unimpaired functionality of the (until then, not actuated) locking device is still present, and the passengers of the vehicle enjoy optimal protection in a vehicle accident. It is therefore a further objective of the present invention to ensure the functional capacity of the door handle assembly, and in particular the locking device, which for a long period of time is, for practical purposes, never actuated. This is achieved in the framework of the invention in that a pivotal movement of the coupling device as the result of a manual actuation of the operating handle causes a movement of the locking device in one of the two blocking directions, without blocking the operating handle and/or the coupling device. A normal, and thus manual, actuation of the operating handle, as well as the effects of an acceleration force, lead to a rotational movement of the locking device. In the first case, the operating handle is first actuated manually by a user, wherein the manual actuation of the operating handle ensures that the locking device rotates. With each manual actuation of the operating handle, the locking device is also moved, by means of which it is ensured that the rotatably supported locking device does not become jammed over time due to the effects of weather, or becomes corroded to the point where it welded in one position. The constant movement of the locking device ensures, moreover, that the locking device retains its functionality even with longer life expectancies. In the second case, a rotation of the locking device results primarily due to an acceleration force acting on the locking device. Due to the different masses, with the effects of an acceleration force the locking device is moved first, before the acceleration force then causes a displacement of the operating handle, or the coupling device, respectively. Because, however, the locking device has already moved in a blocking direction, it blocks the displacement of the coupling device and the operating handle.

A structural, particularly beneficial, possibility for implementing a locking device, which experiences a movement when the operating handle is manually actuated, and blocks a displacement of the operating handle due to the effects of an acceleration force resulting from a vehicle accident, is obtained in the design of the invention in that the coupling device has a lever element with an angled projection that can pivot with it, that enters a cavity—designed in the manner of a slit, for example—in the locking device during the pivoting of the coupling device as the result of a manual actuation of the operating handle, wherein the angled projection pushes against the walls of the slit-shaped cavity during further, displacing actuation of the operating handle, and pushes the locking device in one of the two blocking directions thereby. The movement kinematics of the coupling device, moveably coupled to the operating handle, are used thereby to intervene directly with the locking device, and to move said locking device from the resting position in the direction of one of the two blocking directions. With a normal actuation of the operating handle, the locking device is thus moved together therewith, which, for example, may be the case to a limited extent.

In a further design, the invention provides that the locking device has a disk-shaped blocking body, in which the slit-shaped cavity is designed as a cut running in the radial direction, into which the angled projection of the coupling device can pivot. As a result of this design, the installation space that is to be provided for the locking device can, in particular, then be kept small, if the coupling device is supported on the handle mounting such that it can pivot about a pivotal axis, wherein the rotational axis of the locking device can be oriented substantially parallel to the pivotal axis of the coupling device. Alternatively, it is conceivable that the rotational axis of the locking device is oriented at an angle to the rotational axis of the locking device.

In order that the operating handle is no longer blocked after subjected to the effects of acceleration forces, it is advantageous if a mechanical return element is provided in the design of the invention, which exerts a force pushing the locking device into the resting position. In differing from known locking devices, which lock in position in the event of a crash, as a result of the effects of acceleration forces, and must first be released manually for the operating handle to be actuatable, the operating handle of the door handle assembly according to the invention can thus be used again after it has been subjected to the effects of acceleration forces, and can be actuated, because the locking device is again located in the resting position.

Lastly, it is provided in the design of the invention that the mechanical return element comprises an elastic spring element, which is supported on both a stationary projection on the handle mounting, as well as on a supporting element that moves together with the locking element, wherein, when the locking device moves in the first or second blocking direction, the supporting element moves in relation to the projection, against the force of the elastic spring element.

It is to be understood that the features specified above, and the features still to be explained below, can be used in not only the respective given combinations, but also in other combinations or in and of themselves, without abandoning the scope of the present invention. The scope of the present invention is defined only by the claims.

BRIEF DESCRIPTION OF THE DRAWINGS

Further details, features and advantages of the subject matter of the invention can be derived from the following description in conjunction with the drawings, in which, by way of example, a preferred embodiment example of the invention is depicted. Shown in the drawings are.

DETAILED DESCRIPTION

Figure 1:
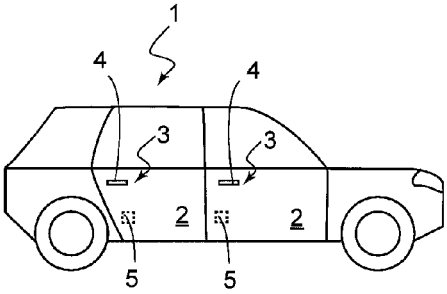
FIG. 1: a side view of a motor vehicle having numerous door handle assemblies according to the invention.

In FIG. 1, a vehicle, or motor vehicle 1, respectively, in the form of a passenger car is shown by way of example, having four doors 2 in the example, which can be opened by means of a door handle assembly 3, and in particular by means of a door handle, or an operating handle 4. The doors 2 are securely closed by means of respective closing assemblies 5, and can only be opened from the outside by means of a respective movement of the operating handle 4. This movement of the operating handle 4 can consist of a pulling and/or lifting movement, wherein the corresponding movement of the operating handle 4 is transferred mechanically to the corresponding closing assembly 5 by at least one coupling device. The corresponding closing assembly 5, and thus the associated door 2, can then be opened by means of the movement of the operating handle 4.

Figure 2:
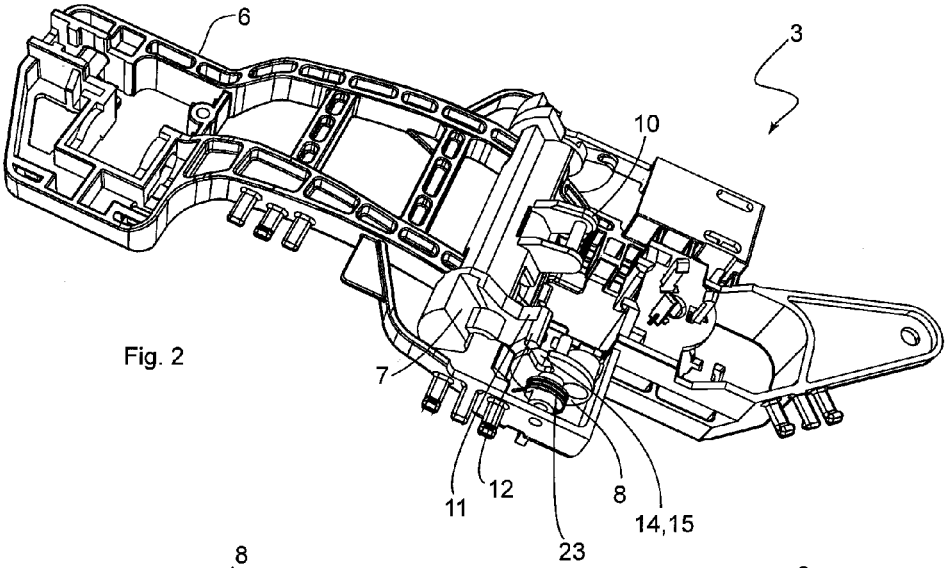
FIG. 2: a perspective view of a door handle assembly according to the invention.

In FIG. 2, a perspective view of the door handle assembly 3 is depicted in greater detail. The door handle assembly 3 has a frame-like handle mounting 6, wherein, for reasons of clarity, there is no depiction of the operating handle 4 in FIGS. 2-10. The handle mounting 6 serves, in the known manner, for the attachment of the operating handle 4, and is attached to the door panel on the inside of the door by means of threaded fasteners, not shown in greater detail, wherein the operating handle 4 is disposed on the outer surface of the door. The handle mounting 6 is formed substantially by a frame structure, in order to save on material, having a variety of accommodating and supporting spaces, in order to be able to also accommodate, aside from the operating handle 4, which is moveably and/or pivotally supported on the handle mounting 6 such that a corresponding door 2 of the motor vehicle can be opened by a user, a mechanical coupling device 7 and a locking device 8.

A movement of the operating handle 4 can be transferred to the corresponding vehicle-side closing assembly 5 by means of the mechanical coupling device 7, in order to open the corresponding door 2 by this means. The locking device 8, serving as a mass locking device, can change its position from a resting position to a blocking position when acted on by an acceleration force, wherein, in the resting position it is possible to actuate the operating handle 4, while, in contrast, in the blocking position, the locking device 8, moveably retained on the handle mounting 6, blocks an actuation of the closing assembly 5 by means of the operating handle 4 and/or a movement of the coupling device 7 by means of an actuation of the operating handle 4. The locking device 8 can move into the blocking position thereby by means of a movement in either a first blocking direction or in a second blocking direction. The second blocking direction is in the opposite direction of the first blocking direction, as shall be explained in greater detail below.

As can be seen, for example, in FIGS. 5-9, the coupling device 8 comprises an axis, or pivotal axis 9, by means of which the coupling device 7 is rotatably, or pivotally, supported on the handle mounting 6, and a displacement lever 10, extending outward (see FIG. 2, by way of example), by means of which a movement of the operating handle 4 is transferred to the coupling device 7. The coupling device 7 is pivotally or rotatably supported in an accommodating space in the handle mounting 6 by means of pivotal axis 9, wherein the movement of the coupling device 7 initiated by the operating handle 4 is transferred to the closing assembly 5 by said coupling device, by means of a transferring element that is not shown (e.g. a Bowden cable).

As can further be derived from FIGS. 2 and 5-9, the coupling device 7 furthermore has a lever element 11. The lever element 11 pivots, together with the coupling device 7, about the pivotal axis 9. At its free end, the lever element 11 has an angled projection 12, which pivots toward the locking device 8 in the clockwise direction, when the coupling device 7 pivots as the result of a manual actuation of the operating handle 4, and acts together therewith.

Figure 3:
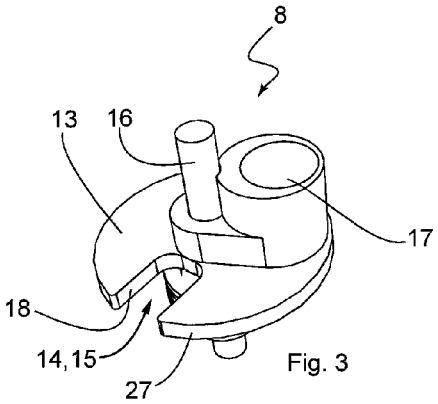
FIG. 3: a perspective top view of a locking device for the door handle assembly.
Figure 4:
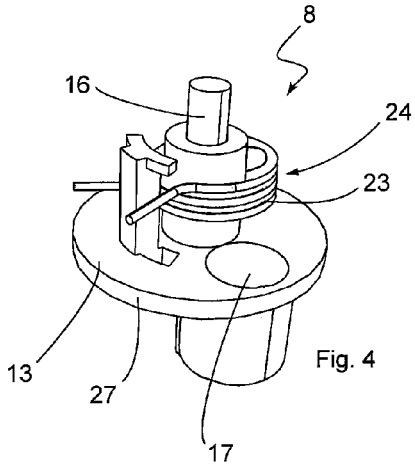
FIG. 4: a perspective view from below of the locking device according to FIG. 3, FIG. 5: a schematic side view of a coupling device and a locking device in the resting position.

The locking device 8 is depicted in FIGS. 3 and 4 from different perspectives. The locking device 8 has a disk-shaped blocking body 13, in which a slit-shaped cavity 14 is formed. The slit-shaped cavity 14 is formed as a cut 15 running radially outward in the disk-shaped blocking body 13, such that the angled projection 12 on the coupling device 7 can pivot into the cut 15. The locking device 8 is rotatably supported on the handle mounting 6 at its midpoint by means of a rotational axis 16, such that a movement of the locking device 8, in a first or second blocking direction for example, is a rotational movement. The locking device 8 has a mass weight 17, which is disposed such that it is offset to the rotational axis 16 on the locking device 8. As a result of this configuration of the mass weight 17, the locking device is moved out of its resting position by the effects of an acceleration force (e.g. resulting from a lateral collision directed toward the interior of the vehicle).

For reasons of clarity, only the locking device 8 and the coupling device 7 are shown in FIGS. 5-9, wherein these two components of the door handle assembly 3 according to the invention would appear to be sufficient for explaining the functionality according to the invention of the door handle assembly 3.

Figure 5:
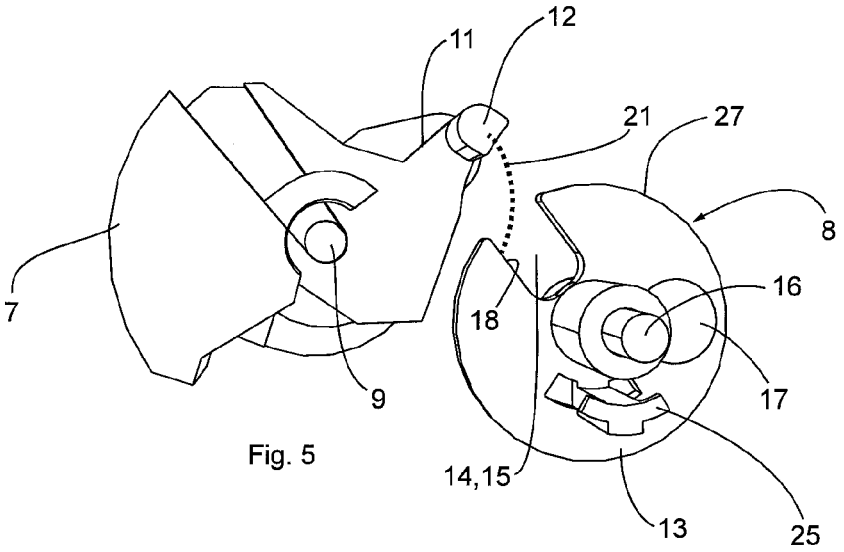

FIG. 5 shows a schematic side view of the locking device 8 in its resting position, in which it is not activated. In the position shown in FIG. 5, the coupling device 7 is disposed in its resting position, because, for example, the operating handle 4 is not actuated, or because no acceleration force resulting from a vehicle accident is acting on the locking device 8. In the resting position of the locking device 8, the slit-shaped cavity 14, or the radial cut 15, respectively, is oriented toward the angled projection 12 of the coupling device 7 such that the angled projection 12 can be inserted into the slit-shaped cavity 14 of the locking device 8 when the coupling device 7 pivots about the pivotal axis 9. The slit-shaped cavity 14 in the locking device 8 is thus disposed in the movement path 21 of the angled projection 12 on the pivoted coupling device 7 when the locking device 8 is in the resting position.

Figure 6:
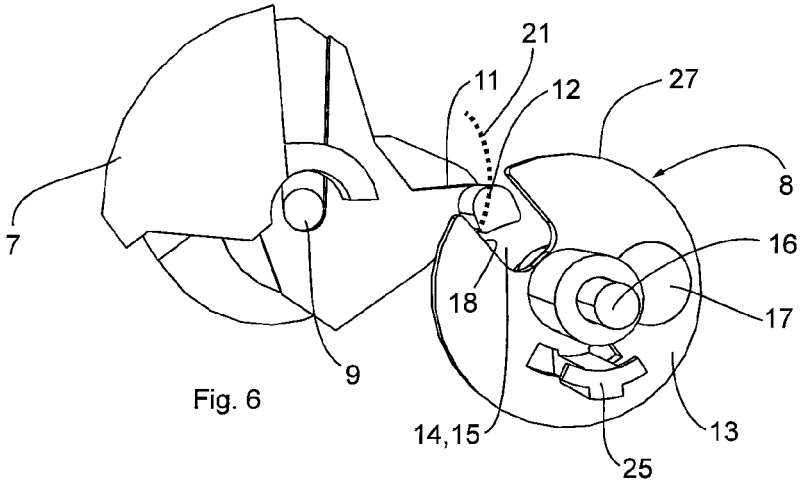
FIG. 6: a schematic side view of the coupling device and the locking device, with the operating handle actuated halfway.

This latter movement has already been fully executed in FIG. 6. The locking device 8 is still in its resting position, while in contrast, the coupling device 7 has pivoted about the pivotal axis 9, which occurs as the result of a manual actuation of the operating handle 4 by a user. When the coupling device 7 is pivoted about the pivotal axis 9, the angled projection 12 of the lever element 11 in the coupling device 8 [sic: 7] is inserted into the slit-shaped cavity 14, or the cut 15, respectively, in the locking device 8, wherein the angled projection 12 of the lever element 11 rests against the wall 18 of the cut 15 in FIG. 6. In FIG. 6, the operating handle is actuated halfway, such that the closing assembly 5 for opening the door has not yet been released, and the locking device 8 is still in the resting position.

Figure 7:
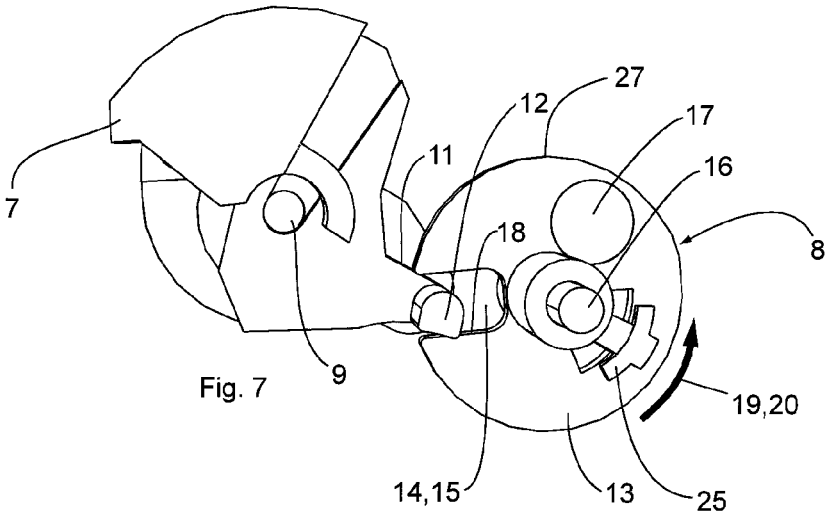
FIG. 7: a schematic side view of the coupling device and the locking device, with the operating handle fully actuated.

The operating handle 4 is fully actuated in FIG. 7, and thus fully displaced, by means of which the coupling device 7 is also fully displaced, as well as pivoted, and thus the closing assembly is released 5, such that the corresponding door 2 of the motor vehicle 1 can be opened. When the operating handle is fully actuated, the coupling device 7 is rotated to the full extent about the pivotal axis 9, such that the angled projection 12 is then no longer only inserted in the slit-shaped cavity 14, or the cut 15, respectively, but also pushes the locking device 8 in a first blocking direction 19 (direction of the arrow 20 in FIG. 7), by means of which the locking device 8 is rotated counter-clockwise about the rotational axis 16 when a normal actuation of the operating handle 4 by a user has occurred.

As soon as the operating handle 4 is no longer actuated, the coupling device 7 is automatically returned to the position shown in FIG. 5, because an elastic spring element, which is not shown in detail in the figures, ensures that the coupling device 7 is returned, and exerts a corresponding force, by means of which the coupling device is pre-loaded in the starting position (see FIG. 5). For the return of the locking device 8 from the position shown in FIG. 7, a mechanical return element 22 is provided, which exerts a force pushing the locking device 8 into the resting position. The return element 22 comprises an elastic spring element 23, which is supported on both a stationary projection 24 of the handle mounting 6 as well as on a supporting element 25 that moves together with the locking element 8. When the locking device 8 moves in the first or second blocking direction, the supporting element 25 moves in relation to the projection 24, against the force of the elastic spring element 23.

Figure 8:
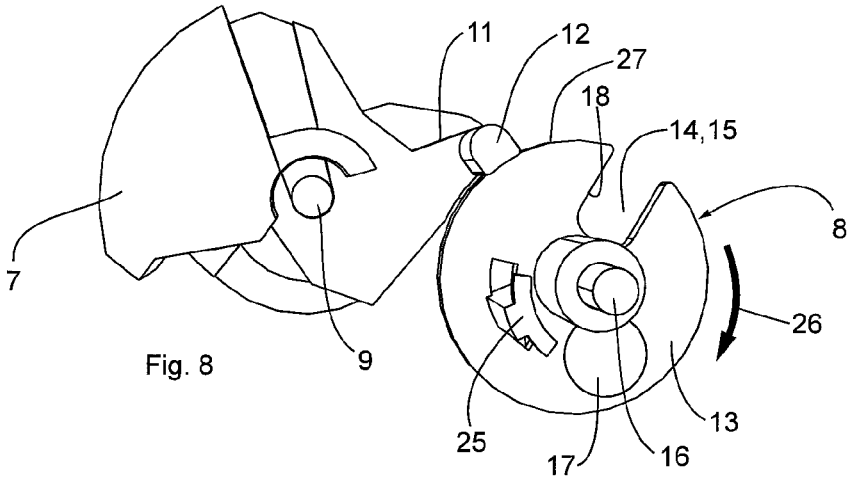
FIG. 8: a schematic side view of the locking device moved in one blocking direction, and the blocked coupling device.
Figure 9:
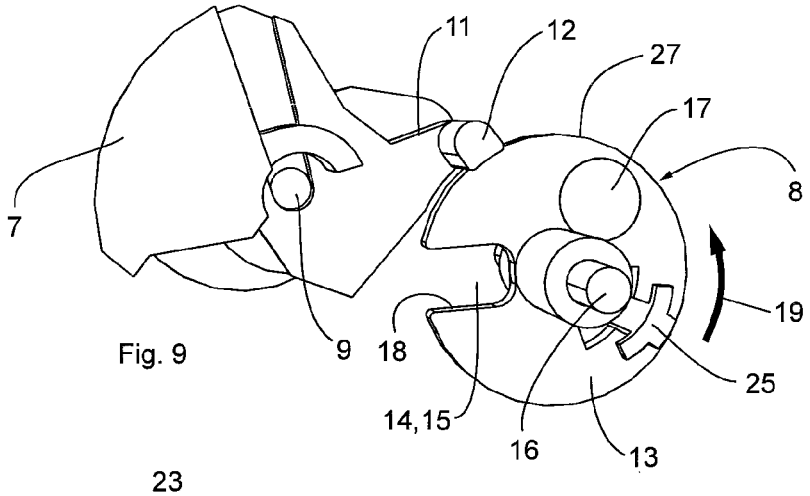
FIG. 9: a schematic side view of the locking device, moved in a blocking direction opposite that shown in FIG. 8, and the blocked coupling device.

While the FIGS. 5, 6 and 7 relate to positions of the coupling device 7 and the locking device 8, which are caused by a manual actuation of the operating handle 4 by a user, and by the interaction of the coupling device 7 and the locking device 8 (these are thus illustrations that do not depict a crash), FIGS. 8 and 9 show positions of both components during a vehicle accident. As the result of the effects of an acceleration force during a vehicle accident, first the locking device 8 moves, due to the inertia of the mass, in relation to the direction in which the acceleration force acts. In FIG. 8, the acceleration force acts laterally on the door 2 on which the door handle assembly is provided, toward the interior of the vehicle ("inboard acceleration"), while in contrast, in FIG. 9 the acceleration force is toward the exterior ("outboard acceleration") and is in the opposite direction of the fundamental acceleration force in FIG. 8. This different direction of the active acceleration force leads to a different displacement of the locking device 8. Thus, in FIG. 8 the effective acceleration force causes a rotation of the locking device 8 out of the resting position (see FIG. 5), about the rotational axis 16, wherein the rotational movement of the locking device 8 in the clockwise direction occurs in a second blocking direction 26. As a result of this rotational movement of the locking device 8, the slit-shaped cavity 14, or the cut 15, respectively, in the disk-shaped blocking body is moved out of the movement path 21 of the angled projection 12 of the coupling device 7, such that an actuation of the operating handle 4, moveably connected to the coupling device 7, is blocked. The locking device 8, with its cavity 14 rotated out of the movement path of the projection 12, prevents, at least, the possibility of fully actuating the operating handle 4, such that it is ensured that the closing assembly 5 is not released. This is because the angled projection 12 can only move as far as the circumferential edge 27 of the disk-shaped blocking body 13 of the locking device 8 when the coupling device 8 [sic: 7] is pivoted, said circumferential edge representing a stopping surface for the angled projection 12 of the lever element 11 of the coupling device 8 [sic: 7]. The description for FIG. 8 given above applies analogously to the position of the locking device 8 shown in FIG. 9, which is, however, rotated from the resting position in the first blocking direction 19 here, which is in the opposite direction of the second blocking direction 26. For this, the locking device 8 can rotate, when subjected to the effects of an acceleration force, at a maximum possible angle of rotation about the rotational axis 16, by means of which a sufficiently long displacement range for blocking the coupling device 7, and thus the operating handle 4, is available. In the depicted embodiment example, the maximum possible angle of rotation is ±270°. In the case of a vehicle accident as well, the locking device 8 can be returned, for which—as has already been explained above—a spring element, not shown in the figures, pushes the coupling device 7 into the starting position, and the return element 22 pushes the locking device 8 into the resting position.

Figure 10:
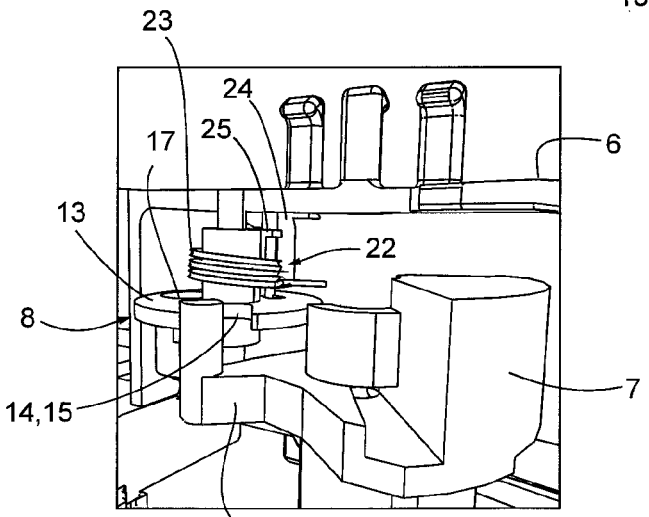
FIG. 10: a perspective view of a mechanical return element for the door handle assembly.

FIG. 10 shows a perspective, enlarged view of the mechanical return element 22 for the door handle assembly 3. The mechanical return element 22 exerts a force that pushes the locking device 8 into the resting position. There is thus no locking element that locks in place, but instead a locking device 3 [sic: 8] that returns to its starting position. The mechanical return element 22 comprises the elastic spring element 23, which is supported at its two ends on both the stationary projection 24 of the handle mounting 6 as well as on the supporting element 25 that moves together with the locking element 8, having corresponding supporting surfaces for the two ends of the spring element 23. The movement of the locking device 8 in the first or second blocking direction 19, 26 as the result of the effects of an acceleration force during a vehicle accident moves the supporting element 25, in relation to the projection 24 on the handle mounting 6, against the force of the elastic spring element 23, in that one of the two ends of the spring element 23 is displaced.

In summary, with the present invention a door handle assembly 3 having a locking device 8 that does not become locked in position is provided, which is distinguished by a secure activation, and securely blocks the operating handle 4, or the coupling device 7, respectively, even in the event of oscillations, or fluttering, respectively, resulting from the effects of acceleration forces. According to the invention, this is enabled in that the locking device 8 can rotate about its rotational axis 16, such that swinging movements in both directions, i.e. rotational movement in opposing directions, are possible for the locking device 8. With the door handle assemblies known from the prior art, the path for the displacement of the locking device, in order for it to move into the movement path of the coupling device, is too short, which leads in practice to situations in which the locking device moves abruptly back after it has been displaced, due to oscillations, and the coupling device is intermittently not blocked, leading to an undesired actuation of the closing assembly, and an opening of the door. This danger no longer exists with the present invention, because the locking device 8 has a longer locking path when activated, which is provided by the rotational movement of 270° about the rotational axis 16. A longer locking path also means that there is a longer locking period in each direction. Furthermore, the locking device 8 can move in two opposing blocking directions 19, 26, such that a blocking of the operating handle 4, or the coupling device 7, respectively, is provided, even with a swinging in two directions, or a fluttering of the locking device 8. According to the embodiments shown here, the rotational axis 16 for the locking device 8 is oriented substantially parallel to the pivotal axis 9 of the coupling device 7. In order to ensure the mobility of the locking device 8, and thus prevent a jamming of the locking device, the angled projection 12 of the lever element 11 for the coupling device 7 moves into the cavity 14 in the locking device 8, and rotates the locking device 8 in the normal operating mode of the operating handle 4, in which said operating handle is manually actuated by a user. The locking device 8, designed as a swinging mass locking device can be designed as a single-piece plastic component with a steel reinforcement, or with a material accumulation.

The invention described above is, as a matter of course, not limited to the embodiments described and illustrated herein. It is clear that numerous changes can be made to the embodiments depicted in the drawings, obvious to the person skilled in the art in accordance with the intended application, without abandoning the scope of the invention thereby. All that is contained in the description and/or depicted in the drawings, including that which is obvious to the person skilled in the art, deviating from the concrete embodiment examples, belongs to the invention thereby.

The invention claimed is:

1. A door handle assembly for a motor vehicle, comprising:

a handle mounting, a manually actuatable operating handle, which is moveably supported on the handle mounting for the opening of a door or a hatch on motor vehicle by a user, a coupling device pivotally mounted on the handle mounting, by means of which a movement of the operating handle can be transferred to a vehicle-side closing assembly, and a locking device serving as a mass locking device, which is moveably retained on the handle mounting and is designed such that, with the effects of an acceleration force which is acting in a first direction, due to the inertia of its mass, it can be moved from a resting position, in which an actuation of the operating handle is possible, in a first blocking direction, in which an actuation of the closing assembly by the coupling device is blocked, wherein the locking device is designed such that, with the effects of an acceleration force which is acting in a second direction, it can be moved from a resting position in a second blocking direction, due to the inertia of its mass, in which an actuation of the closing assembly by the coupling device is blocked, wherein the second blocking direction is in the opposite direction of the first blocking direction wherein the locking device includes a disk-shaped body and is rotatably supported on the handle mounting such that it rotates around a rotational axis, and wherein the movement of the locking device in the first and second blocking directions is a rotational movement.

2. The door handle assembly according to claim 1, wherein the locking device, can be rotated from the resting position, when acted on by an acceleration force, over a maximum possible angle of ±270° about the rotational axis.

3. The door handle assembly according to claim 1, wherein a pivotal movement of the coupling device resulting from a manual actuation of the operating handle causes a movement of the locking device in one of the two blocking directions, without blocking the coupling device.

4. The door handle assembly according to claim 1, wherein the coupling device has a lever element, the lever element being adapted to pivot together with the coupling device about a pivotal axis, the lever element having an angled projection, which is inserted in a slit-shaped cavity in the locking device when the coupling device is pivoted as a result of a manual actuation of the operating handle, wherein the angled projection pushes against the walls of the slit-shaped cavity, when the operating handle is actuated and displaced to a further extent, and pushes the locking device in one of the two blocking directions thereby.

5. The door handle assembly according to claim 4, wherein the slit-shaped cavity is designed in the disk-shaped blocking body in the form of a cut running radially outward, into which the angled projection of the coupling device can pivot.

6. The door handle assembly according to claim 1, wherein the coupling device is supported on the handle mounting such that it can pivot about a pivotal axis, wherein the rotational axis of the locking device is oriented substantially parallel to the pivotal axis of the coupling device.

7. The door handle assembly according to claim 1, wherein a mechanical return element is provided, which exerts a force pushing the locking element into the resting position.

8. The door handle assembly according to claim 7, wherein the mechanical return element comprises an elastic spring element, which is supported on both a stationary projection on the handle mounting as well as on a supporting element that moves together with the locking element, wherein, when the locking element moves in the first or second blocking direction, the supporting element moves in relation to the projection against the force of the elastic spring element.

* * * * *